US007475488B2

(12) United States Patent
Symington

(10) Patent No.: US 7,475,488 B2
(45) Date of Patent: Jan. 13, 2009

(54) TILE SPACER

(76) Inventor: Stephen Symington, 54 Eastfield Ave., Whitley Bay, Tyne & Wear (GB) NE25 8NG ( * ) Notice: Subject to any disclaimer, the term of this patent is extended or adjusted under 35 U.S.C. 154(b) by 160 days.

(21) Appl. No.: 11/214,239

(22) Filed: Aug. 29, 2005

(65) Prior Publication Data

US 2006/0144011 A1 Jul. 6, 2006

(30) Foreign Application Priority Data

Jan. 6, 2005 (GB) ..... 0500120.1
Feb. 2, 2005 (GB) ..... 0502084.7
Jul. 18, 2005 (GB) ..... 0514616.2

(51) Int. Cl.
*G01B 1/00* (2006.01)
*E04G 21/18* (2006.01)

(52) U.S. Cl. ..... 33/526; 33/645; 33/DIG. 20; 52/392; 52/747.11

(58) Field of Classification Search ..... 33/526, 33/527, 562, 645, 613, 1 F, 1 G, 474, 481, 33/518, 567, 502, DIG. 20; 52/747.11, 747.12, 52/392
See application file for complete search history.

(56) References Cited

U.S. PATENT DOCUMENTS 2,031,684 A * 2/1936 Berger ..... 52/396.1
2,930,135 A * 3/1960 Rodtz, Sr. ..... 33/518
3,234,692 A * 2/1966 Bierlich ..... 52/392
3,411,257 A * 11/1968 Yaremchuk ..... 52/415
4,744,194 A * 5/1988 Yasuyoshi ..... 52/747.11
5,010,654 A * 4/1991 Funes, Jr. ..... 33/526
5,201,130 A * 4/1993 Krchnak ..... 33/526
5,623,799 A 4/1997 Kowalski et al.
6,354,058 B1 * 3/2002 Lewis ..... 52/749.11
6,612,045 B2 * 9/2003 Kruskamp ..... 33/526
6,769,191 B1 * 8/2004 Zusman ..... 33/526
2006/0144011 A1 * 7/2006 Symington ..... 52/782.1
2007/0011898 A1 * 1/2007 Frank et al. ..... 33/526

FOREIGN PATENT DOCUMENTS

DE 201 22 280 1/2005
EP 1111157 6/2001

* cited by examiner

*Primary Examiner*—G. Bradley Bennett
*Assistant Examiner*—Amy Cohen Johnson
(74) *Attorney, Agent, or Firm*—MacMillan, Sobanski & Todd, LLC

(57) ABSTRACT

A dual purpose tile spacer and packing shim includes a body having a plurality of arms of equal width, wherein each arm extends radially from a common intersection, and each arm has a bottom edge and a top surface, wherein the respective bottom edges all reside in a common plane and the respective top surfaces do not all reside in a common plane.

18 Claims, 3 Drawing Sheets

TILE SPACER

BACKGROUND OF THE INVENTION

The invention relates to spacers for use in tiling, more particularly to a spacer that can also be used as a packing shim.

The process of laying tiles on surfaces such as walls, floors, or worktops generally involves positioning individual tiles in horizontal rows onto a surface primed with some form of adhesive. Tiles are laid with gaps between adjacent tiles, and this gap is later filled with grout to create a waterproof surface. For aesthetic reasons, these gaps between tiles must be kept uniform in width. Any misalignment of a tile affects the appearance of the tiled surface as a whole.

Tile spacers are generally used while the tiles are being positioned to provide a uniform gap between adjacent tiles. Conventional tile spacers are usually in the form of a cross shape, with four arms of uniform length, width, and depth. These spacers are usually laid at the intersection defined by four tile corners and support the tiles while the adhesive is setting. Once the tile adhesive has set, the spacers are removed either by hand or with pliers prior to the application of grout in the gaps.

Removal of tile spacers prior to grouting is important. If grout is applied on top of a tile spacer, it will not adhere as effectively. Removing conventional tile spacers can be a difficult and time consuming job.

The bottom row of tiles is often laid next to a surface which is perpendicular to the tiled surface. Wall tiles, for example, may be laid with the bottom row next to a floor or a worktop, and floor tiles may be laid next to a wall or skirting board. For aesthetic reasons, this bottom or end row of tiles must also be laid along a straight line. When tiling a wall, the gap between the underside of the lowermost row of tiles and the adjacent surface must be packed in order to support the entire set of tiles until the tile adhesive has set, otherwise the tiles are at risk of slipping. When tiling a floor, the gap between the edge of the end row and the adjacent wall or skirting must also be packed to ensure that all rows of tiles maintain their position until the adhesive has set.

Floors and other surfaces are invariably not perfectly straight, and the distance between the edge of the bottom or end tile and the surface perpendicular to the tile is likely to vary along the length of the intersection of the two perpendicular surfaces. Even if the perpendicular surface is perfectly straight, the edge of the tile may be uneven, as it often is with hand made tiles. The arms of conventional tile spacers all have uniform length, width, and depth and are, therefore, not used for packing the gap between this bottom or end row of tiles and the adjacent surface. To pack this gap, a tiler will use a variety of materials, such as a combination of matchsticks and folded pieces of cardboard of varying depth wedged in between the tile edge and the surface.

It would be desirable to provide an improved tile spacer device that can also be used to accurately pack the end or bottom row of tiles.

SUMMARY OF THE INVENTION

One aspect of the invention provides a device suitable for use as either a tile spacer or a packing shim as specified in the claims.

A further aspect of the invention provides a method for tiling a surface as specified in the claims.

Preferred aspects of the invention are specified in the dependent claims.

The present invention provides a dual purpose removable tile spacer and packing shim. This device enables a tiler to accurately space tiles, as well as easily and accurately support a bottom or end row of tiles using just one product.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
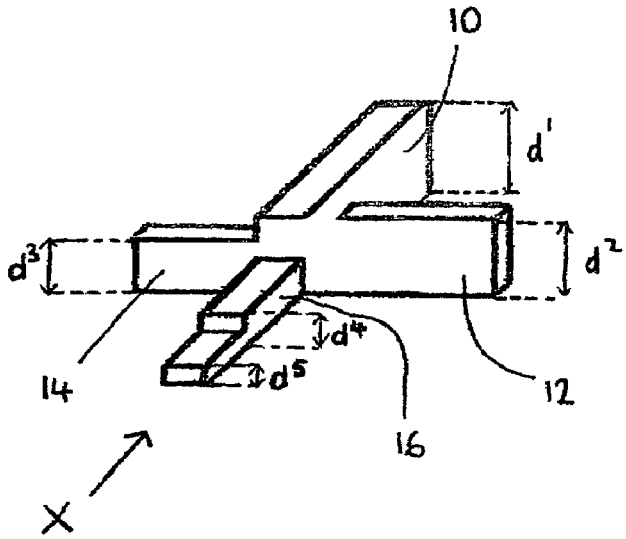
FIG. 1 is a perspective view of one embodiment of the invention.
Figure 2:
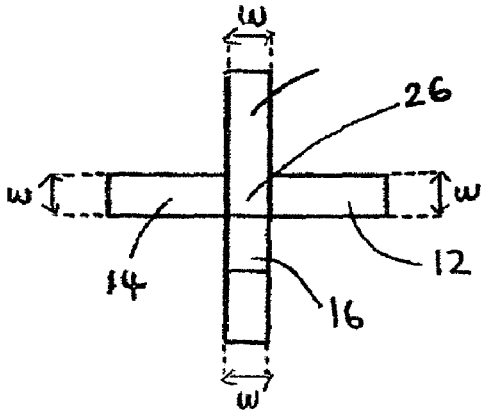
FIG. 2 is a plan view from above of the embodiment illustrated in FIG. 1.
Figure 3:
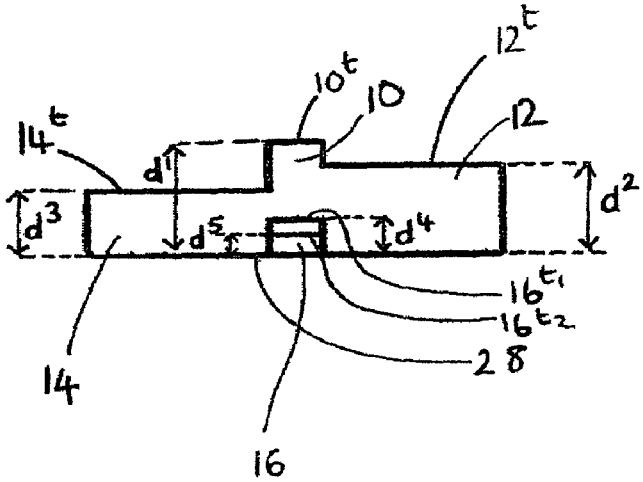
FIG. 3 is a side view along the line X of the embodiment illustrated in FIG. 1.

With reference to FIGS. 1, 2 and 3, a device according to the invention comprises a body in the form of a cross with four arms 10, 12, 14, and 16. The arms extend radially from a common intersection 26, and each arm is arranged at an angle of about 90° to the next arm. Each arm is of uniform width w. The width w sets the spacing between adjacent tiles that will later be filled with grout.

The desired spacing between tiles varies according to the type of surface, size of tile, as well as the personal preference of the tiler. The size of the spacer, and hence width w, may be modified to produce a variety of different sized spacers suitable for various different tiling jobs.

Each arm has a substantially flat bottom edge for positioning against a substantially flat surface to be tiled. The bottom edge of each arm resides in the same plane (see FIG. 3).

The depth of each arm is defined as the distance between a top surface $\mathbf{10}^t$, $\mathbf{12}^t$, $\mathbf{14}^t$, $\mathbf{16}^{t1}$ and $\mathbf{16}^{t2}$ and a base 28 of each arm. In the preferred embodiment, three of the arms 10, 12, and 14 each provide one of three different depths $d^1$, $d^2$, and $d^3$, and one arm 16 comprises two portions each with a different depth $d^4$ and $d^5$. As each arm has a different depth, the top surfaces of all the arms do not reside in a common plane. The depth of the arms decreases incrementally. For example, in a device suitable for wall tiling, the different depths $d^1$ to $d^5$ are 5 mm, 4 mm, 3 mm, 2 mm, and 1 mm respectively.

Figure 4:
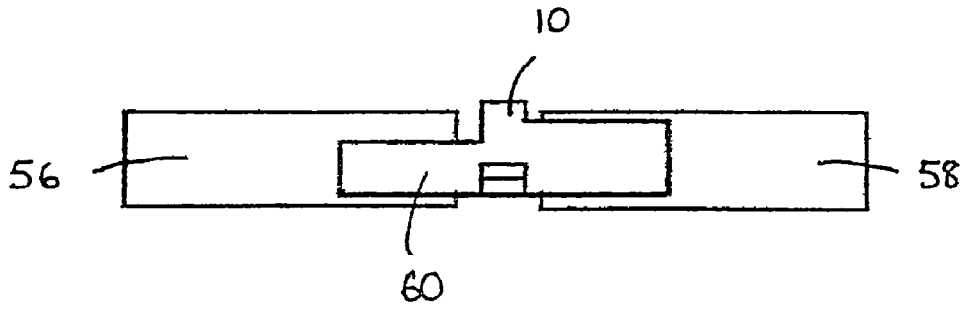
FIG. 4 is an end on view of the embodiment illustrated in FIG. 1 in use as a spacer.

FIG. 4 is an end on view of the device 60 in use as a spacer between two tiles 56 and 58. When the device is used as a spacer, the tallest arm 10 protrudes above the level of the tiles and, in this way, is more easily removed from the surface as arm 10 can easily be gripped with two fingers.

Figure 5:
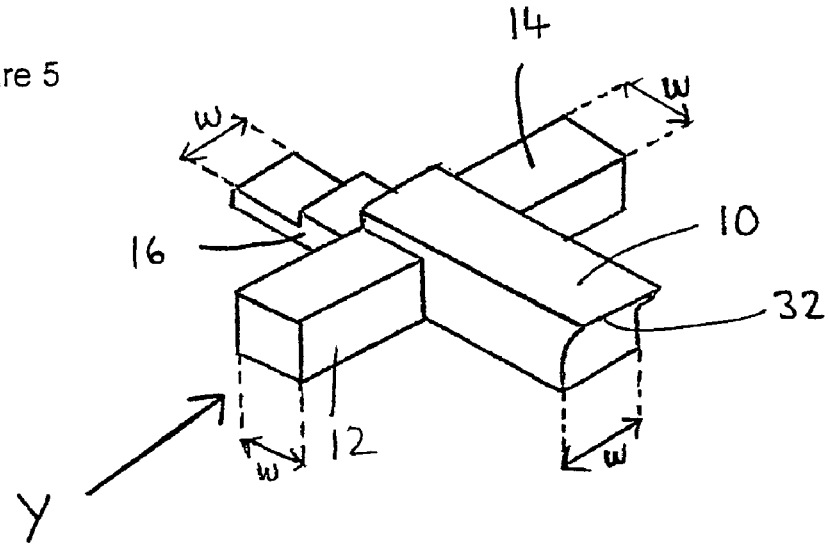
FIG. 5 is a perspective view of an alternative embodiment of the invention.
Figure 6:
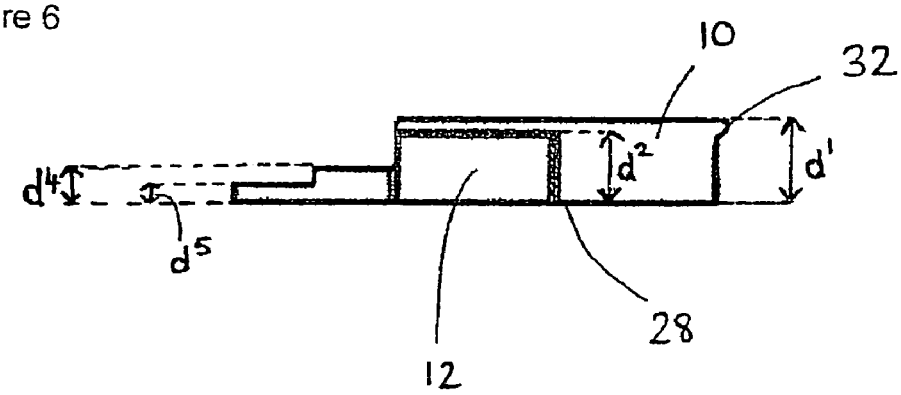
FIG. 6 is a side view along the line Y of the embodiment illustrated in FIG. 4.

An alternative embodiment is illustrated in FIGS. 5 and 6. Common features are illustrated with common reference numerals. In this embodiment, arm 10 comprises an extending portion 32 on its upper surface at the end of the arm. This extending portion acts as a finger pull to aid removal of the spacer prior to grouting. To remove the spacer easily, the tiler simply engages the protrusion with his finger or finger nail and pulls the spacer away from the surface.

Figure 7:
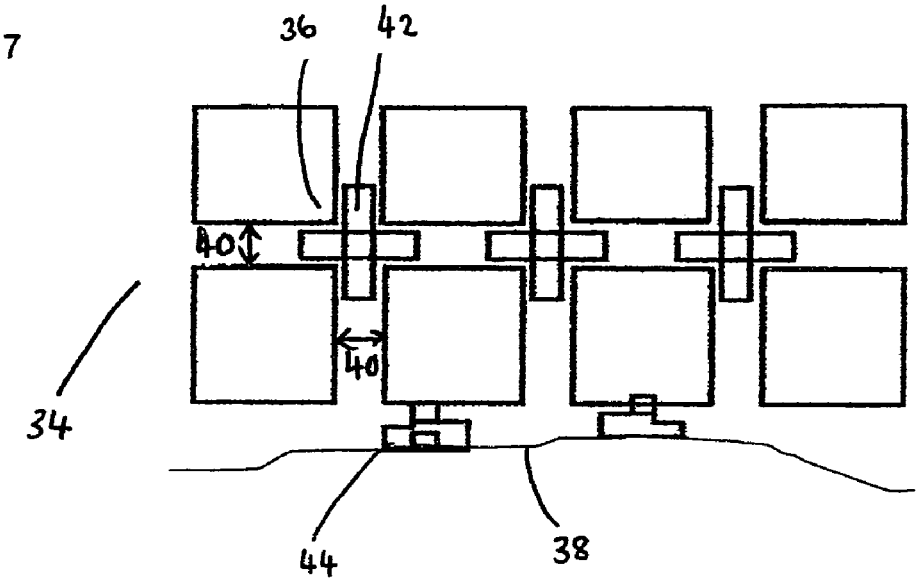
FIG. 7 show the device of the invention in use in tiling a wall.

With reference to FIG. 7, when tiling a wall 34, the device is used as a spacer 42 and is oriented vertically with its base 28 against the wall 34 at the intersection defined by four tile corners 36. The arms of the device have a uniform predetermined width w and define a uniform gap 40 between the tiles.

The surface 38 adjacent to the bottom row of tiles is uneven. To support the bottom row of tiles, the device 1 is used as a packing shim 44, and one of the four arms 10, 12, 14, or 16 is placed into the gap between the bottom tile edge 40 and the surface 38. The four arms provide different depths $d^1$ to $d^5$. The particular arm used will depend on the depth to be packed. Arm 16 has two possible depths $d^4$ and $d^5$ depending on how far into the gap the arm is pushed.

Figure 8:
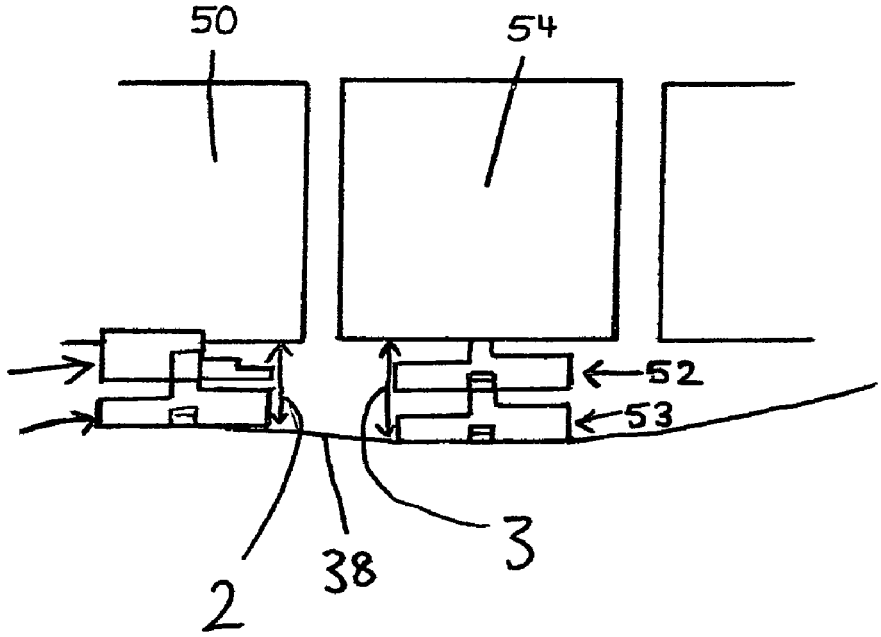
FIG. 8 is an end on view of the device of the invention being used as a packing shim.

More than one device 1 can be stacked upon each other in order to create more varied depths for packing. This is illustrated in FIG. 8, where packing shims numbered 46 and 48 are stacked on top of each other, and arms 12 and 10 respectively are inserted into the gap 2 between tile 50 and the surface 38. The packing shims numbered 52 and 53 are stacked on top of each other, and arms 10 on both packing shims are inserted into the gap 3 between tile 54 and the surface 38. For example, in a device suitable for wall tiling the different depths $d^1$ to $d^5$ are 5 mm, 4 mm, 3 mm, 2 mm, and 1 mm respectively. Using this example applied to FIG. 8, the gap 2 between tile 50 and the surface 38 is 9 mm and the gap 3 between tile 54 and the surface 38 is 10 mm. Two of these devices may be stacked to create a packing shim with a depth in the range 6 mm to 10 mm, and three spacers may be stacked creating a packing shim with a depth in the range 11 mm to 15 mm and so on. In this way incremental changes in shim depth are possible.

Dual purpose tile spacers and packing shims are provided in a plurality of colors and finishes, including white, transparent, and translucent. White, transparent, or translucent spacers may be preferred if a tiler does not intend to remove the spacers prior to the application of grout.

A range of spacers, each one of the range having a different width w, is provided, the range of widths w providing for differently sized gaps between adjacent tiles. Tile spacers are commonly available with widths w of 2 mm, 3 mm, 4 mm, 5 mm, and 7 mm. In a preferred embodiment of the invention, each different width of the tile spacer device of the invention is available in a different color. For example a 2 mm spacer may be black in color, a 3 mm spacer may be red, and a 4 mm spacer may be blue. Color coding the spacers assists the tiler in identifying the correct size spacer for a particular tiling job and also aids removal of the spacers after tiling, as the colored spacers stand out from the background, especially on a white surface.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A dual purpose tile spacer and packing shim comprising:

a body having a plurality of arms of equal width, each arm extending radially from a common intersection, each arm having a bottom edge and a top surface, wherein the respective bottom edges all reside in a common plane, and the respective top surfaces all define planes that are parallel but do not all reside in a common plane, wherein each arm has a different depth.

2. A dual purpose tile spacer and packing shim as claimed in claim 1, wherein the body comprises four arms.

3. A dual purpose tile spacer and packing shim as claimed in claim 1, wherein one of the arms has a distal end remote from the common intersection, said one of the arms further comprising an extending portion at the distal end on the top surface in order to facilitate removal of the spacer.

4. A dual purpose tile spacer and packing shim as claimed in claim 1, wherein the arms are arranged at substantially 90° to each other.

5. A dual purpose tile spacer and packing shim as claimed in claim 1, wherein at least one arm comprises two portions each of a different depth.

6. A dual purpose tile spacer and packing shim as claimed in claim 1, wherein the depth of each arm is in the range from 1 mm to 20 mm.

7. A dual purpose tile spacer and packing shim as claimed in claim 1, wherein the depth of each arm is in the range from 1 mm to 5 mm.

8. A dual purpose tile spacer and packing shim as claimed in claim 1, wherein the width of each arm is the range from 1 mm to 20 mm.

9. A dual purpose tile spacer and packing shim as claimed in claim 1, wherein the body is color coded to identify the predetermined width of each arm.

10. A method of tiling a substantially flat surface comprising the steps of:

covering the surface to be tiled with an adhesive composition suitable for adhering the tiles to the surface;

placing tiles onto the adhesive in rows by placing at least one of the dual purpose tile spacer and packing shim as claimed in claim 1 at the intersection defined by four tile corners with the base of the device against the surface;

supporting the tiles by placing one arm of said at least one of the dual purpose tile spacer and packing shim into a gap between the edge of a tile and a surface adjacent to the tiled surface;

removing the dual purpose tile spacer and packing shims; and applying grout or other finishing medium into the gaps between the tiles.

11. A dual purpose tile spacer and packing shim comprising:

a body having four arms of equal width, each arm extending radially from a common intersection, each arm having a bottom edge and a top surface, wherein the respective bottom edges all reside in a common plane, and the respective top surfaces are all parallel, wherein each arm has a different depth.

12. A dual purpose tile spacer and packing shim as claimed in claim 11, wherein one of the arms has a distal end remote from the common intersection, said one of the arms further comprising an extending portion at the distal end on the top surface in order to facilitate removal of the spacer.

13. A dual purpose tile spacer and packing shim as claimed in claim 11, wherein the arms are arranged at substantially 90° to each other.

14. A dual purpose tile spacer and packing shim as claimed in claim 11, wherein at least one arm comprises two portions each of a different depth.

15. A dual purpose tile spacer and packing shim as claimed in claim 11, wherein the depth of each arm is in the range from 1 mm to 20 mm.

16. A dual purpose tile spacer and packing shim as claimed in claim 11, wherein the depth of each arm is in the range from 1 mm to 5 mm.

17. A dual purpose tile spacer and packing shim as claimed in claim 11, wherein the width of each arm is the range from 1 mm to 20 mm.

18. A dual purpose tile spacer and packing shim as claimed in claim 11, wherein the body is color coded to identify the predetermined width of each arm.

* * * * *